United States Patent [19]

Bassett

[11] 4,005,622

[45] Feb. 1, 1977

[54] CIRCULAR SAW WRENCH

[76] Inventor: Alvin L. Bassett, 102 S. 13th St., St. Joseph, Mo. 64501

[22] Filed: Apr. 30, 1976

[21] Appl. No.: 681,917

[52] U.S. Cl. ..... 81/180 R; 81/121 R; 81/53 R

[51] Int. Cl.[2] ..... B25B 13/48

[58] Field of Search ..... 29/200 D, 240; 81/53 R, 81/121 R, 180 R, 180 C

[56] References Cited

UNITED STATES PATENTS

| | | | |
|---|---|---|---|
| 1,502,156 | 7/1924 | Pearce et al. | 81/53 R |
| 2,459,672 | 1/1949 | Morsch | 81/180 R X |
| 3,170,347 | 2/1965 | Brye | 81/121 R |

*Primary Examiner*—Al Lawrence Smith
*Assistant Examiner*—James G. Smith
*Attorney, Agent, or Firm*—John A. Hamilton

[57] ABSTRACT

A wrench for tightening or loosening the central mounting screw of a circular saw blade consisting of a pair of lever handles pivotally joined on an axis transverse thereto. The first lever handle carries a wrench socket engageable over the mounting screw, and extends radially from the socket. The second lever is pivoted to the first lever coaxially with the wrench socket and extends radially therefrom, and carries a laterally projecting restraining finger parallel to but spaced apart from the pivotal axis, the finger being engageable between a successive pair of the teeth of the saw. The second lever is longitudinally slidable relative to the pivot axis to adjust the tool to saw blades of different diameters, and the wrench socket is detachably mounted to permit the use of sockets of different sizes.

10 Claims, 4 Drawing Figures

CIRCULAR SAW WRENCH

Figures 1, 2, 3, 4:
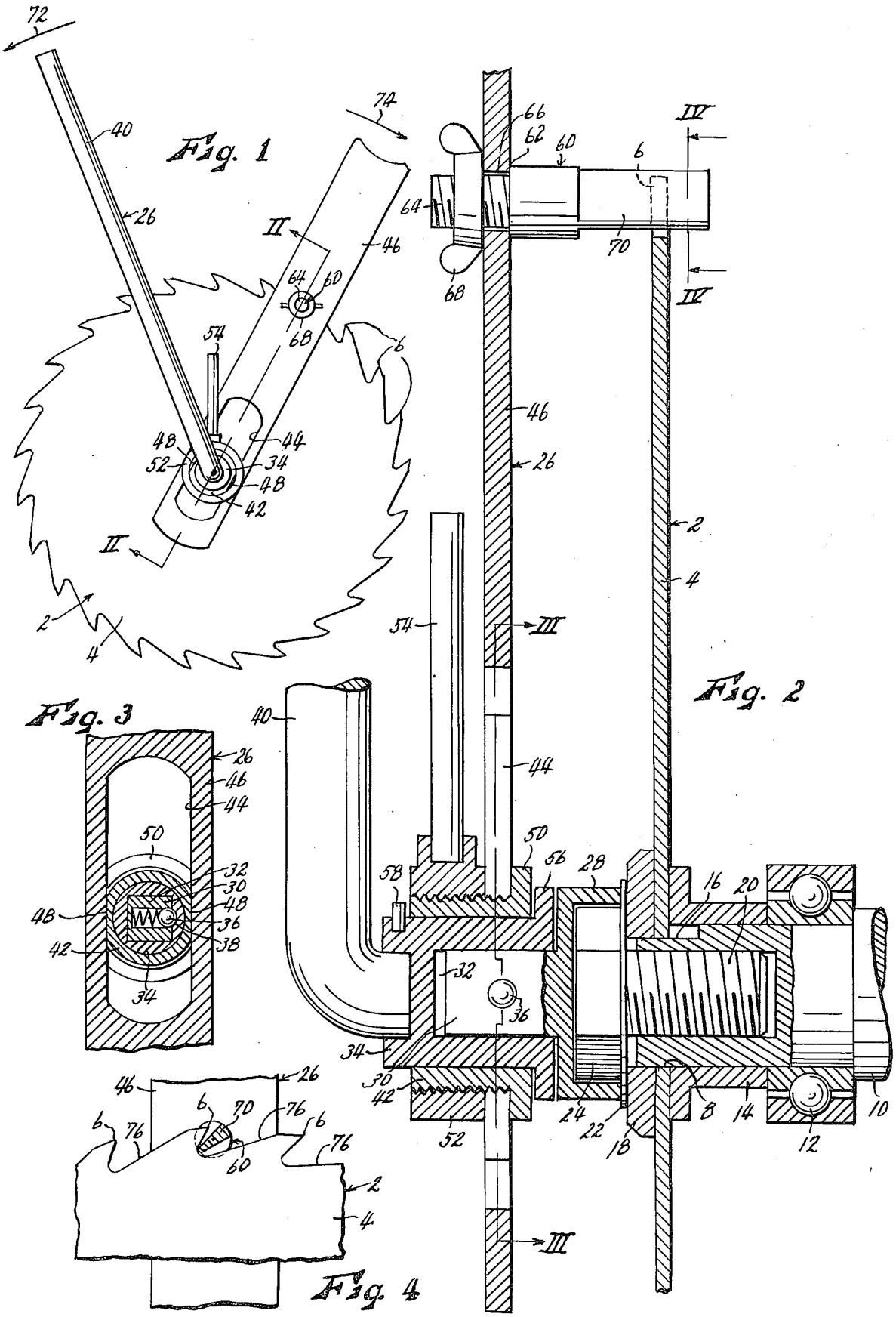

This invention relates to new and useful improvements in wrench-type tools, and has particular reference to a wrench for tightening or loosening the central mounting screws of circular saw blades.

A circular saw blade, consisting of a circular, planar steel plate with its peripheral edge portion serrated to form cutting teeth, is customarily mounted rigidly and coaxially on a power-driven spindle, by means of a cap screw extended through a central aperture of the blade and threaded into the spindle, the blade being clamped between the head of the screw and a flange associated with the spindle. The mounting screw must be set tightly. Tightening or loosening said screw is an operation often accompanied by frustration, and some danger. The counter-reactive force of any wrench applied to the screw head must be resisted by holding the blade itself against rotation by the wrench. If it is attempted to hold the blade with one hand while turning the wrench with the other, there is always a danger that the hand will be lacerated or otherwise injured by the extremely sharp teeth of the blade. If the blade is held by means of any device engaging the saw teeth themselves, and sufficiently hard to resist damage by the teeth, there is always the possibility that the keen cutting edges of the teeth will be damaged.

Accordingly, the principal object of the present invention is the provision of a wrench for tightening or loosening the mounting screw of a circular saw blade which not only protects the hands of the operator against injury by the blade teeth, but also protects the blade teeth against damage by the wrench. Generally, this is accomplished by the provision of a wrench including two levers pivoted together on an axis parallel to the axis of the blade, and extending radially from said axis. The first lever carries a wrench socket coaxial with the pivotal axis and engageable over the head of the mounting screw. The second lever carries a restraining finger parallel to but spaced apart from the pivotal axis, and engageable between any successive pair of teeth of the blade.

Another object is the provision of a wrench of the character described which is readily adjustable to circular saw blades of different diameters. This may be accomplished by adjusting the pivotal axis of the wrench socket closer to or farther from the restraining finger.

A further object is the provision of a wrench of the character described wherein the spacing between the wrench socket and the restraining finger may be locked, as may be required if the saw teeth are inclined in a certain manner, or if the threads of the mounting screw are left handed, for example.

A still further object is the provision of a wrench of the character described which is adapted to receive wrench sockets of different sizes, whereby to be adapted to engage mounting screws of different sizes.

Other objects are simplicity and economy of construction, and efficiency, ease and dependability of operation.

With these objects in view, as well as other objects which will appear in the course of the specification, reference will be had to the accompanying drawing, wherein:

FIG. 1 is a face view of a circular saw blade, with a wrench embodying the present invention applied operatively thereto, FIG. 2 is an enlarged, fragmentary sectional view taken on line II—II of FIG. 1, with all of the operating levers moved into angular registry, FIG. 3 is a reduced, fragmentary sectional view taken on line III—III of FIG. 2, and FIG. 4 is a reduced, fragmentary sectional view taken on line IV—IV of FIG. 2.

Like reference numerals apply to similar parts throughout the several views, and the numeral 2 applies generally to a circular saw blade of ordinary design, consisting of a planar, circular steel plate 4 having its peripheral edge portion serrated to form saw teeth 6, and having a central orifice 8 (see FIG. 2). The blade teeth as shown are operable when the blade is turned in a counter-clockwise direction as viewed in FIG. 1. As shown in FIG. 2, said blade is mounted on a power driven spindle 10, usually driven by a motor (not shown) and journalled in a motor housing (not shown) by means of a ball bearing 12. The spindle projects through central orifice 8 of the blade, the blade being spaced apart from bearing 12 by bushing 14. The spindle and blade orifice are provided with corresponding flats, as indicated at 16, to prevent relative rotation thereof. A thick washer 18, also provided with an internal flat at 16, is applied over the extreme end of spindle 10, and secured by a mounting cap screw 20 inserted axially through washer 18 and threaded into a socket provided therefor in spindle 10. A thin spring washer 22 is usually inserted between washer 18 and the enlarged, non-circular head 24 of screw 20.

The wrench forming the subject matter of the present invention, and usable to insert or remove blade mounting screw 20, is indicated generally by the numeral 26, and includes a female wrench socket 28 which is internally configurated to be applied axially but non-rotatively over head 24 of said screw. Said screw head and socket are indicated as hexogonal, but other shapes are in common use. Extending axially from the back of said socket is an integral square drive lug 30 which is insertable in a correspondingly shaped socket 32 formed in a cylindrical spindle 34 coaxial with said lug, and being releasably secured in said socket by a spring-loaded detent ball 36 of an ordinary type, said ball engaging in a recess 38 formed in a wall of socket 32. A lever handle 40 is fixed in the opposite end of spindle 34, and is bent to extend radially from the socket axis to a distance greater than the radius of the largest saw blade with which the wrench may be used. Being rigidly affixed thereto, spindle 34 may be considered an angled portion of lever handle 40 itself.

Spindle 34 is externally cylindrical, and is rotatably mounted in a generally cylindrical sleeve 42. Said sleeve projects through a longitudinally elongated slot 44 formed in a second lever handle 46, adjacent one end thereof. Lever handle 56 has the form of a flat bar extending at right angles to the axis of rotation of spindle 34 in sleeve 42, and also extends from said axis by a distance greater than the radius of the saw blade. Said sleeve may be moved longitudinally along slot 44, but is provided with external flats 48 engaging the sides of slot 44 to prevent rotation thereof about its own axis. At the end of said sleeve toward wrench socket 28, said sleeve is provided with an external flange 50 which lies against one side of lever handle 46. The sleeve projects through slot 44 and outwardly from the opposite side of lever 46, and is externally threaded, having a circular nut 52 engaged thereon and bearing against the face of lever 46 opposite from that engaged by flange 50. By tightening nut 52 to clamp lever 46 firmly between itself and flange 50, sleeve 42 may be secured against sliding movement in slot 44. Nut 52 may be turned by means of a short lever handle 54 affixed therein and extending radially therefrom. Spindle 34 has an external flange 56 at one end thereof engaging flange 50 of the sleeve, and a radially extending pin 58 fixed in the opposite end thereof projecting outwardly from sleeve 42, whereby axial sliding of the spindle in the sleeve is prevented.

In longitudinally spaced apart relation from slot 44 of lever handle 46, a restraining finger 60 is fixed in said lever handle, projecting therefrom parallel to and in the same direction as socket 28. Said finger is shouldered at 62, and has a threaded and reduced portion 64 extended rotatably through a hole 66 formed therefor in lever 46, with a wingnut 68 threaded thereon. By loosening said wingnut, the finger may be turned adjustably on its axis. The end portion 70 of said finger extending from the lever in the same direction as socket 28 is configurated to form a narrow wedge shape in cross-sectional contour, as best shown in FIG. 4.

In the use of the wrench to loosen mounting screw 20, socket 28 is first fitted over head 24 of said screw, as shown in FIG. 2. Then, with nut 52 loosened, lever handle 46 is moved longitudinally, with its slot 44 moving diametrically over sleeve 42, until wedge portion 70 of restraining finger 60 is engaged between any successive pair of teeth 6 of the blade, as shown in FIG. 4. This setting will of course be determined by the radius of the saw blade. Usually the saw teeth are undercut, as shown, and the wedge formation of the finger engages only in the base of the undercut, also as shown. If necessary, wingnut 68 may be loosened and the finger turned on its axis to insure this type of engagement thereof between the saw teeth. No portion of the finger should engage or be engaged by the cutting edges of said teeth, which are disposed at the extreme outer points thereof.

Then the parts may have the relative positions shown in FIG. 1, and screw 20 may be loosened by turning the two lever handles 40 and 46 in angularly opposite directions, as indicated by arrows 72 and 74. The motion of handle 46 turns socket 28 to loosen the screw, while restraining finger 60 restrains the saw blade from turning with the socket. The operator need not touch the saw blade, so that he does not risk injury by the saw teeth, and no part of the wrench touches the cutting edges of the saw teeth, so that there is no danger of damaging the blade. Screw 20 may be tightened by reversing the procedure described above.

With the saw blade as shown, and if mounting screw 20 has right hand threads, there is no need for retightening nut 52 during the loosening operation, since the direction of force application to restraining finger 60 forces the finger into the undercut of the saw tooth in use, there is hence no tendency of the force to slide lever handle 46 outwardly over spindle sleeve 42. However, in the tightening operation, the direction of force application to finger 60 is reversed, and the inclination of tooth edge 76 (see FIG. 4) would cause said edge to cam lever handle 46 slidably outwardly over sleeve 42 so that the finger might "ratchet" over the saw teeth with possible damage thereto. This may be prevented by tightening nut 52 prior to the tightening operation, to lock lever handle 46 against sliding movement relative to sleeve 42. This locking of handle 46 on sleeve 42 may be required even during the loosening operation if, for example, screw 20 had left hand threads, or if the saw teeth were inclined oppositely to the direction shown, as is sometimes the case, and also may be desired in repetitive work, wherein a plurality of like blades are being applied to or removed from their power spindles 10 at the same time. In some cases, instead of screw 20, spindle 10 itself is threaded and the saw blade secured thereon by a nut threaded directly on the spindle. The present tool is equally adapted for use on such nuts.

While I have shown and described a specific embodiment of my invention, it will be readily apparent that many changes of structure and operation could be made without departing from the spirit of the invention.

What I claim as new and desire to protect by Letters Patent is:

1. A wrench for tightening or loosening the central mounting screw of a circular saw blade, said wrench comprising:

a. first and second elongated lever handles, b. pivot means connecting said lever handles together for relative angular movement about an axis transverse to said lever handles, c. a wrench socket carried fixedly by the first of said lever handles, said socket opening coaxially with said pivotal axis and being operatively engageable over the head of said mounting screw, and d. a restraining finger fixed to the second of said lever handles, being parallel to but spaced apart from said pivotal axis, and being adapted, when said wrench socket is applied to said mounting screw, to project between a consecutive pair of teeth of said saw blade.

2. A wrench as recited in claim 1 wherein said pivot means in slidable relative to said second lever handle in a direction transverse to said pivotal axis, whereby the lateral spacing between said wrench socket and restraining finger may be adjusted to saw blades having different diameters.

3. A wrench as recited in claim 2 with the addition of means operable to secure said pivot means releasably at any selected position in its slidable adjustable movement relative to said second lever handle.

4. A wrench as recited in claim 1 wherein said second lever handle has an elongated slot formed longitudinally therein, an angled portion of said first lever handle projecting through said slot transversely of said second lever handle, said angled portion of said first lever handle being rotatable on its axis and slidably movable in said slot longitudinally of said second lever handle.

5. A wrench as recited in claim 1 wherein said second lever handle has an elongated slot formed longitudinally therein, and wherein said pivot means constitutes a tubular sleeve projecting through said slot transversely of said second lever handle, and being transversely slidable in said slot in a direction longitudinal to said second lever handle, an angled portion of said first lever handle being carried coaxially and rotatably in said sleeve.

6. A wrench as recited in claim 5 with the addition of clamping means operable to secure said sleeve releasably against transverse sliding movement in said slot.

7. A wrench as recited in claim 5 wherein said sleeve is externally configurated to be non-rotatable about its axis within said slot, is provided at one end with an external flange bearing against one side of said second lever handle, and is externally threaded, being provided with an enlarged nut threaded thereon to bear against the opposite side of said second lever handle.

8. A wrench as recited in claim 1 wherein said restraining finger has a narrow wedge shape in cross-sectional contour, with the point of said wedge shape directed to enter between the saw blade teeth, whereby to engage said blade only in the base portion of the notch between successive teeth, and not the cutting edges of said teeth.

9. A wrench as recited in claim 8 wherein said restraining finger is mounted in said second lever handle for rotation about its own axis, and with the addition of means operable to secure said finger against rotation at any desired angular position, whereby to adjust the angle of the wedge portion of said finger to the configuration of the saw teeth of said blade.

10. A wrench as recited in claim 1 wherein an angled portion of said first lever handle is disposed coaxially with said pivotal axis and said wrench socket is disposed coaxially therewith, said first lever handle and said wrench socket being provided, not necessarily respectively, with a non-circular socket and a mating non-circular drive lug, whereby said wrench socket may be detached from said first lever handle for interchangeable mounting of wrench sockets of different sizes.

* * * * *